United States Patent [19]

Suzuki

[11] 4,407,776

[45] Oct. 4, 1983

[54] SHAPE MEMORY ALLOYS

[75] Inventor: Kikuo Suzuki, Suita, Japan

[73] Assignee: Sumitomo Special Metals, Ltd., Osaka, Japan

[21] Appl. No.: 360,566

[22] Filed: Mar. 22, 1982

[30] Foreign Application Priority Data

Mar. 25, 1981 [JP] Japan ..... 56-44580

[51] Int. Cl.[3] ..... C22C 9/01

[52] U.S. Cl. ..... 420/477; 420/478; 420/489; 148/402

[58] Field of Search ..... 148/402, 434, 436, 130, 148/131; 420/478, 489, 471, 402

[56] References Cited

U.S. PATENT DOCUMENTS

| | | | |
|---|---|---|---|
| 3,475,227 | 10/1969 | Coule et al. | 420/489 |
| 3,551,214 | 12/1970 | Ford et al. | 420/489 |
| 3,832,243 | 8/1974 | Donkersloot et al. | 148/402 |
| 4,274,872 | 6/1981 | Melton et al. | 148/402 |

*Primary Examiner*—L. Dewayne Rutledge
*Assistant Examiner*—Debbie Yee
*Attorney, Agent, or Firm*—Burns, Doane, Swecker & Mathis

[57] ABSTRACT

A shape memory alloy consisting essentially of, by weight ratio, 2 to 15% aluminium, 0.01 to 3% beryllium and the balance being substantially copper, with impurities being inevitably present in the process of preparation, and a shape memory alloy further including 0.05 to 15% zinc, both including composition ranges which allows cold work.

6 Claims, 2 Drawing Figures

SHAPE MEMORY ALLOYS

BACKGROUND OF THE INVENTION

The present invention relates to copper base type shape memory alloys, and more particularly to improvements in copper-aluminium type shape memory alloys.

The shape memory effect is occasionally called a heat recoverable effect which refers to phenomena that an initially thermostable shape deforms into a further thermo-unstable shape which, upon heating, returns to the initial thermostable shape. Certain types of alloys of Ni-Ti, Au-Cd, Cu-Al-Ni or the like systems have been known to possess such an effect, and applied to a particular field of technology, while development of novel heat recoverable alloys and application of them to another field are now in progress.

The shape memory effect of copper type alloys emerges as phenomena that they are heated into a single phase of beta brass type sturcture (the beta phase), and cooled down to or below a temperature at which the martensite transformation start (the $M_s$ point), preferably to a temperature below the temperature at which the martensite transformation is completed (the $M_f$ point), thereat deformed, so that, upon heating to the temperature at which the reverse martensite transformation is completed (the $A_f$ point), they resume their original shape. To such phenomena, the occurrence of the martensite transformation is essential.

However, either binary copper-aluminium alloys or binary copper-zinc alloys are impractical, since the former alloys have a very high transformation temperatures, whereas the latter too low transformation temperatures. This has led to studies about elements for lowering the $M_s$ points of copper-aluminium alloys or raising those of copper-zinc alloys. As a result, the alloys of Cu-Al-Zn, Cu-Zn-Sn, Cu-Zn-Si, Cu-Al-Mn, Cu-Al-Fe, Cu-Al-Ni, Cu-Al-Sn, Cu-Zn-Ga, Cu-Au-Zn or the like systems have already been proposed as the alloys having the shape memory effect. Among these alloys, however, only the alloys of Cu-Al-Zn system are put to practical use (see U.S. Pat. No. 3,783,037 and a Japanese Patent Application laid open for public inspection under No. 52-116720) in view of easiness with which the alloying elements are prepared and their workability.

Nonetheless, there is left much to be desired for the Cu-Al-Zn alloys because, to obtain the required properties, they should contain a considerably large amount of zinc.

To add to this, the Cu-Al-Zn alloys have a disadvantage that their shape memory properties vary in the course of production or during use. Improvements in this respect are also desired in the art. The reasons for the variation in such properties are presumed to be ascribable to dezincification occurring in the course of production or during use.

SUMMARY OF THE DISCLOSURE

An object of the present invention is therefore to provide novel shape memory alloys.

Another object of the present invention is to provide shape memory alloys which are entirely or substantially free from the disadvantages the prior art offers.

A further object of the present invention is to provide cold-workable shape memory alloys.

These and other objects and features of the present invention will become apparent from the following detailed description.

According to the present invention, the zinc is wholly or partly replaced by beryllium to remove the disadvantages conventional Cu-Al-Zn alloys have, thereby rendering the application of a practical range of $M_s$ points possible, and suppressing the changes in shape memory properties. In a preferred embodiment of the present invention, satisfactory plastic workability is also obtained.

Thus the present invention provides a shape memory alloy consisting essentially of, by weight ratio, 2 to 15% aluminium, 0.01 to 3% beryllium and the balance being substantially copper, with impurities being inevitably present in the process of preparation.

The present invention also involves the provision of shape memory alloys consisting essentially of, by weight ratio, 2 to 15% aluminium, 0.01 to 3% beryllium, 0.05 to 15% zinc and the balance being substantially copper, with impurities being inevitably present in the process of preparation.

The second-mentioned alloys can eliminate the influence of zinc.

DETAILED DESCRIPTION OF THE INVENTION

Figure 1:
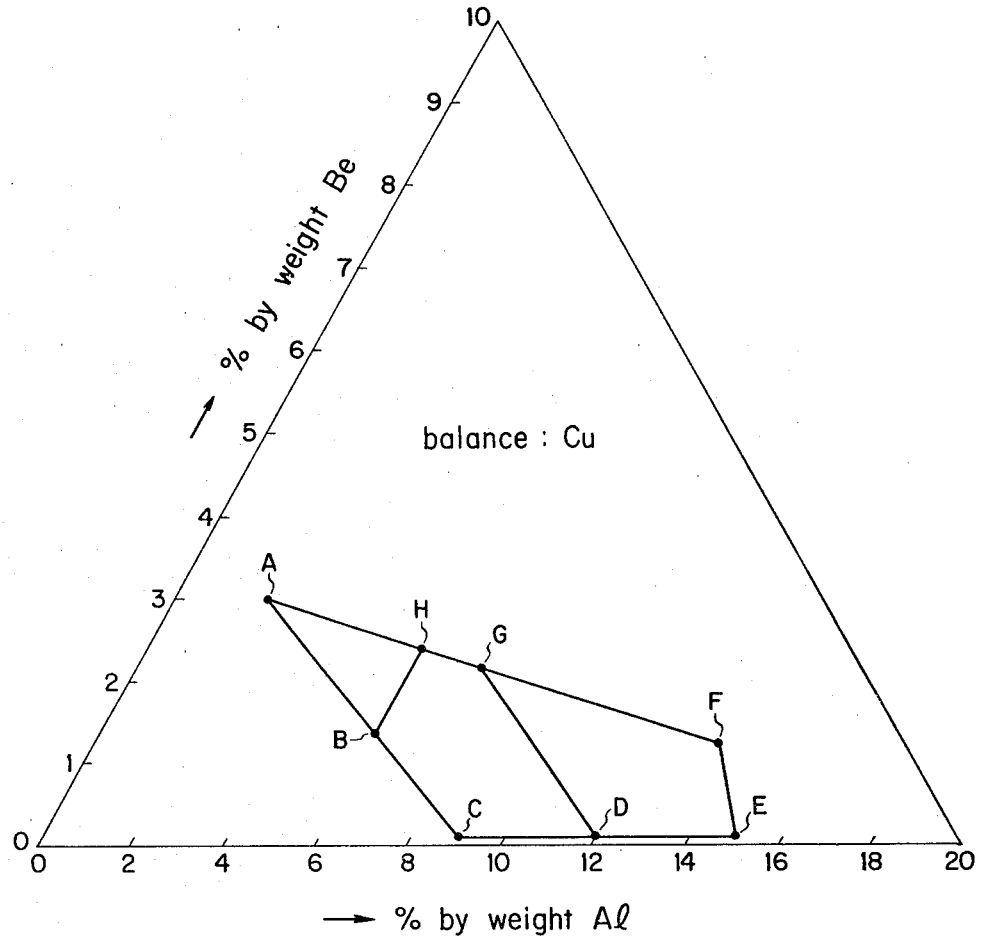
FIG. 1 shows a ternary system defining the inventive composition range of the ternary Cu-Al-Be alloys.

The composition range of the ternary alloys according to the present invention is limited to a range within the closed line ACEFA in FIG. 1 for the following reasons:

Outside of segment AF: an impractical $M_s$ point of −200° C. or less is obtained Outside of segment AC: the composition is not transformed into the single beta phase and remains in two-phase (alpha+beta) state until its melting point is reached Outside of segment CE: no shape memory effect is produced Outside of segment EF: the composition is not transformed into the single beta phase and remains in two-phase (beta+gamma) state until its melting point is reached Preferable is a range encircled by a closed line BCDGHB, in which cold work (plastic work) is possible.

In FIG. 1, the balance is copper. Vertices and points A-H are expressed in terms of (Al, Be) coordinates as follows; by weight ratio, A: 2% Al, 3% Be, the balance Cu; B: 6% Al, 1.3% Be, the balance Cu; C: 9% Al, 0.01% Be, the balance Cu; D: 12% Al, 0.01% Be, the balance Cu; E: 15% Al, 0.01% Be, the balance Cu; F: 13.5% Al, 1.25% Be, the balance Cu; G: 7.5% Al, 2.15% Be, the balance Cu; H: 6% Al, 2.4% Be, the balance Cu.

The second quaternary Cu-Al-Be-Zn alloys essentially consist of, by weight ratio, 2 to 15% aluminium, 0.01 to 3% beryllium, 0.05 to 15% zinc and the balance being substantially copper, with impurities being inevitably present in the process of preparation, provided that the limits for aluminium and beryllium are basically identical with those for the (first) ternary alloys. In the quaternary system of FIG. 2, the inventive quaternary alloys consist in a range defined by a hexahedron whose vertices are denoted by I, J, K, L, M, N, O and P and on the borderline thereof. Cold-workable alloys, which are more practical, consist in a range defined by a heptahedron whose vertices are denoted by R, J, S, T, Q, N, U, V and W and on the boderline thereof. These vertices are expressed in terms of four-dimentional (Al, Be, Zn, Cu) coordinates system as follows (by weight ratio);

| | | | | | | |
|---|---|---|---|---|---|---|
| Hexahedron IJKLMNOP wherein the balance is copper | | | | | | |
| I: | 2% | aluminium, | 3% | beryllium, | 0.05% | zinc |
| J: | 9% | " | 0.01% | " | 0.05% | " |
| K: | 15% | " | 0.01% | " | 0.05% | " |
| L: | 13.5% | " | 1.25% | " | 0.05% | " |
| M: | 1.7% | " | 2.6% | " | 15% | " |
| N: | 3.4% | " | 0.01% | " | 15% | " |
| O: | 13.0% | " | 0.01% | " | 15% | " |
| P: | 11.5% | " | 1.1% | " | 15% | " |
| Heptahedron RJSTQNUVW wherein the balance is copper | | | | | | |
| R: | 6% | aluminium, | 1.3% | beryllium, | 0.05% | zinc |
| S: | 12% | " | 0.01% | " | 0.05% | " |
| T: | 7.5% | " | 2.15% | " | 0.05% | " |
| Q: | 6% | " | 2.4% | " | 0.05% | " |
| U: | 10.2% | " | 2.1% | " | 15% | " |
| V: | 6.4% | " | 1.9% | " | 15% | " |
| W: | 3.4% | " | 2.3% | " | 15% | " |

Figure 2:
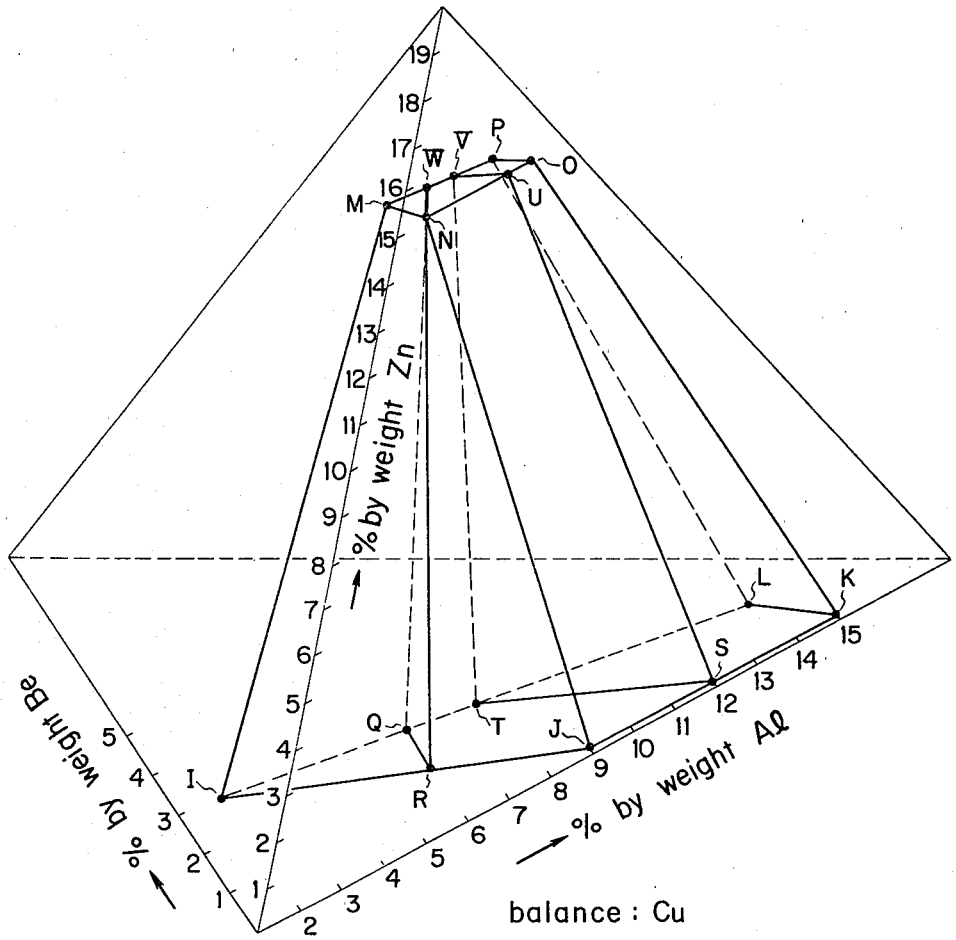
FIG. 2 shows a quaternary system defining the inventive composition range of the quaternary Cu-Al-Be-Zn alloys.

It is noted that vertices I, R, J, S, K, L, T and Q of FIG. 2 have the aluminium and beryllium contents cooresponding to vertices A to H in FIG. 1.

Referring to the limits for the components of the inventive quaternary alloys, the aluminium and beryllium are basically identical with those of the ternary Cu-Al-Be alloys. When the Be content is less than the hexahedral range, no shape memory effect is produced, whereas when it is beyond the range, an impractical $M_s$ point of −200° C. or less is obtained. When the Al content is less than or beyond the hexahedral range, the composition remains in two-phase (alpha+beta) state or (beta+gamma) state, respectively, until its melting point is reached, so that no single beta phase is attained. When the zinc content is less than the hexahedral range, no shape memory effect is produced, whereas when it is beyond the range, the effect of the beryllium added is offset. The balance is copper and inevitable impurities.

The first and second alloys according to the present invention may contain inevitable impurities. Beryllium may usually be added as a copper-beryllium mother alloy which may contain at most 0.5 weight % of impurities such as silicon, iron, aluminium, cobalt, magnesium, manganese, nickel, etc. Usually, the aluminium to be used has a purity higher than 99.5%, the copper to be used a purity higher than 99.9%, and the zinc to be used a purity higher than 99.5%. The impurities originating from these starting materials can be tolerated if the total amount thereof is at most 0.5 weight %.

The alloy of the present invention is prepared by melting of a composition having the relative composition; however, such a composition has to be transformed into the beta single phase by given heat treatment to obtain a shape memory alloy. The heat treatment itself may be effected in the manner similar or analogous to that used for conventional shape memory alloys such as ternary copper-zinc-aluminium alloys. However, "as-cast" alloys can be hot-rolled at a temperature of 700° to 800° C. These alloys are obtained by heating at a temperature of 800° to 900° C. until the beta phase is formed, followed by quenching.

The ternary copper-beryllium-aluminium alloys according to the present invention are characterized in the following advantageous points:

1. By the addition of beryllium, the $M_s$ point of the binary system of copper-aluminium can be reduced to a practical range of −200° C. to +200° C.

2. Like ternary Cu-Al-Zn alloys, the inventive alloys can be cold-worked within a certain composition range, and is thus of great value from the industrial standpoint.

3. The amount of the third component beryllium required for obtaining the same $M_s$ point is less than that of zinc as compared with the ternary Cu-Al-Zn alloys.

4. Replacement of zinc by beryllium hardly brings about such disadvantages as done by the addition of much zinc as is the case with conventional Cu-Al-Zn alloys.

Practical shape memory alloys are obtained even by further addition of zinc, which acts to lower the $M_s$ point of the binary system of copper-aluminium, to the inventive ternary Cu-Be-Al alloys.

The quaternary alloys according to the present invention are characterized in the following points:

1. The presence of beryllium results in a considerable reduction in the amount of zinc required to obtain the same $M_s$ point, as compared with Cu-Al-Zn alloys.

2. For this reason, improvements in corrosion resistance may be expected.

3. The presence of beryllium makes great contribution to improvements in mechanical properties inclusive of strength.

The composition range of the inventive ternary alloys is further defined in terms of workability and shape memory effect.

Workability deteriorates to such an extent that cold work is difficult when the Al and Be contents exceed 15% and 3%, respectively, while the shape memory effect is not produced when they are below 2% and 0.01%, respectively. Such ternary alloys do not possibly incur fluctuations of the $M_s$ point thanks to the absence of zinc. According to the present invention, the shape memory effect is attained by the addition of beryllium in lieu of zinc to the binary system of copper-aluminium. As a result, shape memory alloys excelling in workability are obtained. According to the present invention, said amount of beryllium can also be applied with zinc, provided that zinc is comprised in an amount of 0.05 to 15% so as to remove or reduce the disadvantages arising from the addition of much zinc. When the Zn content exceeds 15%, the disadvantage again arise, inherent in conventional copper-aluminium-zinc alloys.

Reference will now be made to the examples of the inventive alloys, to which the invention is not restricted, however.

EXAMPLES

A copper-beryllium mother alloy (Cu-4% Be, and impurities such as Si, Fe, Al, Co, Mg, Mn, Ni, etc.), aluminium having a purity of 99.5%, electrolytic copper having a purity of 99.9% and zinc having a purity of 99.5% were prepared in the proportion as specified in Table 1, and melted in a high-frequency melting furnace. The resultant melt was cast in a mold of 50×50×200 mm size into an ingot which was, in turn, heated to 700°-800° C. and hot-rolled to a plate of 6 mm thickness. Samples of 5×5×50 mm size were cut out of the rolled plate for the determination of $M_s$ points.

Namely, the samples were transformed into the beta single phase at a temperature of 800°-900° C., subsequently quenched, and the changes in electrical resistance with temperature for the determination of $M_s$ points were ploted. Table 1 shows the components of the alloys under experiment and the $M_s$ points thereof.

TABLE 1

| | components (% by weight) | | | | Ms point | shape memory | heat-treatment temperature for obtaining | |
|---|---|---|---|---|---|---|---|---|
| | Al | Be | Zn | Cu | (°C.) | affect | β-phase | cold work |
| 1 | 10.94 | 0.56 | — | balance | −2 | yes*** | 800° C. | possible |
| 2 | 8.95 | 0.78 | — | " | +20 | " | " | " |
| 3 | 9.55 | 0.86 | — | " | −23 | " | " | " |
| 4 | 7.11 | 1.03 | — | " | +27 | " | " | " |
| 5 | 3.55 | 2.45 | — | " | −160 | " | 850° C. | impossible |
| 6 | 11.02 | 1.50 | — | " | −195 | " | 800° C. | " |
| 7 | 13.53 | 0.26 | — | " | −18 | " | " | " |
| 8 | 7.90 | 0.47 | 10.78 | " | +70 | " | " | possible |
| 9 | 4.90 | 0.49 | 14.89 | " | −50 | " | 900° C. | " |
| 10* | 10.05 | 2.03 | — | " | below −200 | uncertain | 800° C. | impossible |
| 11* | 5.50 | 1.05 | — | " | — | — | none** | possible |

N.B.:
*Nos. 10 and 11 not according to the invention.
**The composition is not transformed into the β phase and remains in α, β two-phase state until its melting point reached.
***"yes" denotes observed.

Of these samples, the cold-workable samples were repeatedly annealed at 550°-600° C., and cold-rolled to a thickness of 0.5 mm for the determination of shape memory effect. However, Samples 5 to 7, which were found to be not cold-workable, were heated to 800° C., and hot-rolled to a thickness of 0.5 mm for the same purposes. The thus prepared samples were heat-treated at a temperature permitting the beta phase transformation, and bent at temperatures below their $M_s$ points. The bent samples were heated at temperatures above their $A_f$ points, at which they exhibited the shape memory effect, as shown in Table 1.

The workability of the samples were determined by cold-rolling. The results are also shown in the table.

As described above, the present invention provides novel shape memory alloys which are obtained by replacing beryllium for the whole or part of the zinc in conventional ternary Cu-Al-Zn alloys, and which undergo no or little fluctuation of the $M_s$ point resulting from the presence of much zinc, that is one major demerit of the prior art alloys, and are easily produced in an industrial scale without deterioration in workability.

What is claimed is:

1. A shape memory alloy of the beta-brass type structure consisting essentially of, by weight ratio, 2 to 15% aluminium, 0.01 to 3% beryllium and the balance being substantially copper, with impurities being inevitably present in the process of preparation, said alloy having a composition range encircled by a closed line ACEFA in FIG. 1 where, by weight ratio, A: 2% aluminium, 3% beryllium, the balance copper;
C: 9.0% aluminium, 0.01% beryllium, the balance copper;
E: 15% aluminium, 0.01% beryllium, the balance copper; and
F: 13.5% aluminium, 1.25% beryllium, the balance copper.

2. A shape memory alloy of the beta-brass type structure consisting essentially of, by weight ratio, 2 to 15% aluminium, 0.01 to 3% beryllium, and 0.05 to 15% zinc and the balance being substantially copper, with impurities being inevitably present in the process of preparation, said alloy having a composition range encircled by a hexahedron defined by vertices IJKLMNOP in the quaternary system of Cu-Al-Be-Zn of FIG. 2 where, by weight ratio, I: 2% aluminium, 3% beryllium, 0.05% zinc, the balance copper;
J: 9% aluminium, 0.01% beryllium, 0.05% zinc, the balance copper;
K: 15% aluminium, 0.01% beryllium, 0.05% zinc, the balance copper;
L: 13.5% aluminium, 1.25% beryllium, 0.05% zinc, the balance copper;
M: 1.7% aluminium, 2.6% beryllium, 15% zinc, the balance copper;
N: 3.4% aluminium, 0.01% beryllium, 15% zinc, the balance copper;
O: 13.0% aluminium, 0.01% beryllium, 15% zinc, the balance copper; and
P: 11.5% aluminium, 1.1% beryllium, 15% zinc, the balance copper.

3. The alloy as recited in claim 1, which can be cold-worked, and has a composition range encircled by a closed line BCDGHB of FIG. 1 where, by weight ratio, B: 6% aluminium, 1.3% beryllium, the balance copper;
D: 12% aluminium, 0.01% beryllium, the balance copper;
G: 7.5% aluminium, 2.15% beryllium, the balance copper; and
H: 6% aluminium, 2.4% beryllium, the balance copper.

4. The alloy as recited in claim 1 or 2, in which said inevitable impurities are contained in an amount of at most 0.5% by weight.

5. The alloy as recited in claim 4, in which said inevitable impurities are silicon, iron, cobalt, magnesium, aluminium, manganese or nickel or a mixture of two or more of these elements.

6. The alloy as recited in claim 2, which can be cold-worked, and has a composition range encircled by a heptahedron defined by vertices RJSTQNUVW in the quaternary system of FIG. 2 where, by weight ratio, R: 6% aluminium, 1.3% beryllium, 0.05% zinc, the balance copper;
S: 12% aluminium, 0.01% beryllium, 0.05% zinc, the balance copper;

T: 7.5% aluminium, 2.15% beryllium, 0.05% zinc, the balance copper;

Q: 6% aluminium, 2.4% beryllium, 0.05% zinc, the balance copper;

U: 10.2% aluminium, 2.1% beryllium, 15% zinc, the balance copper;

V: 6.4% aluminium, 1.9% beryllium, 15% zinc, the balance copper; and

W: 3.4% aluminium, 2.3% beryllium, 15% zinc, the balance copper.

* * * * *

UNITED STATES PATENT AND TRADEMARK OFFICE

CERTIFICATE OF CORRECTION

PATENT NO. : 4,407,776

DATED : October 4, 1983

INVENTOR(S) : KIKUO SUZUKI

It is certified that error appears in the above-identified patent and that said Letters Patent is hereby corrected as shown below:

In the Heading:

Please correct the city of the inventor to read -- Osaka, Japan --;

Please correct the Assignee to read -- Sumitomo Special Metals Co., Ltd. --;

Column 5, Table 1, third heading from the right, please change "shape memory affect" to read -- shape memory effect --.

Signed and Sealed this

Twenty-fourth Day of April 1984

[SEAL]

Attest:

GERALD J. MOSSINGHOFF

Attesting Officer

Commissioner of Patents and Trademarks